US008210160B2

(12) United States Patent
Wood

(10) Patent No.: US 8,210,160 B2
(45) Date of Patent: Jul. 3, 2012

(54) PAINTBALL MARKER WITH SELF PURGING REGULATOR

(75) Inventor: Jack Kingsley Wood, Chesire (GB)

(73) Assignee: Planet Eclipse Limited, a company of the United Kingdom, Manchester (GB)

( * ) Notice: Subject to any disclaimer, the term of this patent is extended or adjusted under 35 U.S.C. 154(b) by 491 days.

(21) Appl. No.: 12/511,619

(22) Filed: Jul. 29, 2009

(65) Prior Publication Data

US 2010/0024792 A1 Feb. 4, 2010

Related U.S. Application Data

(60) Provisional application No. 61/084,821, filed on Jul. 30, 2008.

(51) Int. Cl.
*F41B 11/00* (2006.01)

(52) U.S. Cl. ..... 124/73; 137/68.23; 137/234.5; 137/505.42

(58) Field of Classification Search ..... 124/73–77; 137/505.25, 68.23, 234.5, 468; 89/193
See application file for complete search history.

(56) References Cited

U.S. PATENT DOCUMENTS

| | | | | |
|---|---|---|---|---|
| 3,474,816 | A * | 10/1969 | Burgess | 137/238 |
| 6,899,125 | B2 * | 5/2005 | Ellero et al. | 137/505.42 |
| 7,757,681 | B2 * | 7/2010 | Gabrel | 124/73 |
| 2006/0249132 | A1 * | 11/2006 | Gabrel | 124/70 |
| 2008/0210210 | A1 * | 9/2008 | Colby | 124/73 |
| 2009/0229591 | A1 * | 9/2009 | Gabrel | 124/73 |

* cited by examiner

*Primary Examiner* — Troy Chambers
(74) *Attorney, Agent, or Firm* — Barlow, Josephs & Holmes, Ltd.

(57) ABSTRACT

An improved normally open (NO) gas pressure regulator is provided. Preferably, the regulator is employed with a paintball marker and operates as a NO regulator yet automatically purges the retained pressure downstream of the regulator upon removal of the supply pressure. The gas pressure regulator of the present invention includes a pressure-controlled plunger inside the NO regulator that allows the regulated downstream gases to be purged from the system as the supply source is removed from the marker. Accordingly, since the downstream regulated gases are allowed to exit the system when the supply source is removed, the regulated gas pressure is released and the paintball marker is rendered inoperable and safe.

18 Claims, 8 Drawing Sheets

PAINTBALL MARKER WITH SELF PURGING REGULATOR

CROSS-REFERENCE TO RELATED APPLICATIONS

This application is related to and claims priority from earlier filed U.S. Provisional Patent Application No. 61/084,821, filed Jul. 30, 2008, the contents of which are fully incorporated herein by reference.

BACKGROUND OF THE INVENTION

The present invention relates generally to an improved gas regulator that is configured and arranged to automatically release retained gas pressure. More specifically, the present invention relates to an improved gas regulator for controlling the distribution of compressed gas throughout a paintball marker or other compressed gas powered projectile firing device while automatically purging any retained pressure downstream of the regulator upon removal of the supply pressure.

In the sport of paintball, pneumatically operated guns are employed to launch paint capsules at a participant's opponent. In operation, pressurized gas is rapidly released into the breach of the pneumatically operated gun behind a projectile that is loaded therein. The release of the pressurized gas in turn discharges the projectile outwardly from the barrel of the pneumatically operated gun, launching the projectile at an opponent. In this regard, in order to operate, such pneumatically operated paintball guns require the use of a reliable source of compressed air or other gas. Such a supply of compressed gas is generally provided in the form of a portable gas cylinder that is mounted to the gun. In this arrangement, a large volume of highly pressurized compressed gas is stored in the gas cylinder, wherein relatively small amounts of the gas are metered out at a reduced pressure in order to operate the marker and launch the projectiles. To achieve this metering operation, the use of pressure regulators in paintball markers has become commonplace, so that the desired output pressure from the gas storage cylinder can be reliably controlled.

Typically these gas regulators have been fairly crude devices that severely limit the ability of users to control the operational parameters of the paintball marker. To meet the growing demand for higher performance paint ball markers, pressure regulators that exhibit improved performance characteristics have been developed. These improved pressure regulators are designed to control unwanted pressure spikes from the gas storage cylinders in order to keep the pressure entering the pneumatic gun stable and well as to control the velocity of the ejected paintball by directly controlling the input pressure into the paintball marker's valve chamber.

In this regard, there are currently two predominant regulator designs currently being used in pneumatically operated paintball markers. The first regulator type is an upstream or normally closed (NC) design where the pressure of the supply gas within the gas storage cylinder biases the regulator against the regulator main spring force allowing gas pressure to enter the firing chamber. The regulator in the NC arrangement closes once the gas in the firing chamber reaches the desired operational pressure. In the NC design, removal of the supply pressure to the regulator, by removal of the gas storage cylinder, allows the regulator main spring to become the dominant biasing force that in turn allows the regulator seal mechanism to open. Once the regulator seal opens, any regulated downstream gases retained within the marker are then purged backwards through the system and released.

The second regulator type is a downstream or normally open (NO) design shown in prior art FIGS. 1-5. The NO regulator depicted at 10 in FIG. 1 is the most prolifically used regulator in paintball markers, due to its combination of ease of manufacture, reliability and performance. In the NO regulator 10 design the regulated downstream gas pressure 12 is the dominant force biasing the regulator piston 14 to a closed position against the combined force of the supply gas pressure and the regulator main spring force 16. As supply gas 15 flows through the regulator seat 18 shown at FIG. 2, the down stream pressure behind the regulator piston 14 increases thereby displacing it downwardly. Once the downstream pressure reaches the operational pressure setting of the regulator, the regulator piston 14 urges the seal 20 into contact with the regulator seat as shown in FIG. 3, preventing any additional flow of supply gas from the gas storage container. As the pressure of the downstream gas decreases, the regulator main spring causes the regulator piston to move upwardly thereby opening the regulator seat to allow additional gas to flow as shown in FIG. 4.

The difficulty with the NO regulator 10 design is that by its nature, the design includes a hereditary safety issue in the fact that it leaves the paintball marker energized with compressed gases even after the supply gas source has been removed. As can be seen in FIG. 5, even after the gas supply 15 is removed and the supply pressure is eliminated, the regulated downstream gases 12 remain the dominant biasing pressure against the regulator main spring 16. As a result the regulator seal 20 mechanism remains closed against the regulator seat 18 causing the regulated downstream gas 12 to remain trapped downstream of the regulator seal 20 mechanism. Since the regulated gas 12 is not free to purge back through the system, the operational end of the paintball marker remains pressurized. Often the retained regulated gas 12 is at a sufficient pressure and volume to subsequently fire a paintball at, or close to full velocity, even after the gas supply has been removed. This has obvious safety implications for paintball markers that use this type and design of regulator to control the gas supply to the marker.

There is therefore a need for a pressure regulator for a paintball marker that preserves the operational benefits and reliability of a NO regulator yet automatically purges the retained pressure downstream of the regulator upon removal of the supply pressure.

BRIEF SUMMARY OF THE INVENTION

In this regard, the present invention provides an improved gas pressure regulator for a paintball marker that preserves the operational benefits and reliability of a NO regulator yet automatically purges the retained pressure downstream of the regulator upon removal of the supply pressure. The gas pressure regulator of the present invention includes a pressure-controlled plunger inside the NO regulator that allows the regulated downstream gases to be purged from the system as the supply source is removed from the marker. Accordingly, since the downstream regulated gases are allowed to exit the system when the supply source is removed, the regulated gas pressure is released and the paintball marker is rendered inoperable and safe.

In addition to the components contained within a traditional NO regulator, the present invention also incorporates a self-purging pressure bleeding feature that can be found mounted inside the regulator piston. The self-purging feature is a pressure biased plunger that is designed to selectively allow communication of the supply gas side and the downstream regulated gas side of the regulator. In normal operation, with supply gas attached to the supply inlet, the self-purging feature remains closed maintaining the seal between the regulator seat and the regulator seal. However, when the supply gas pressure is removed, the self-purging element is displaced downwardly by the down stream regulated gas pressure. This movement of the self-purging element allows the downstream regulated gases to flow back through the regulator seal and back out of the supply inlet of the regulator. As a result, the retained pressure of the regulated gas is purged thereby depressurizing the paintball marker rendering it safe.

It is therefore an object of the present invention to provide a pressure regulator for a paintball marker that preserves the operational benefits and reliability of a NO regulator yet automatically purges the retained pressure downstream of the regulator upon removal of the supply pressure rendering the paintball marker inoperable and safe.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
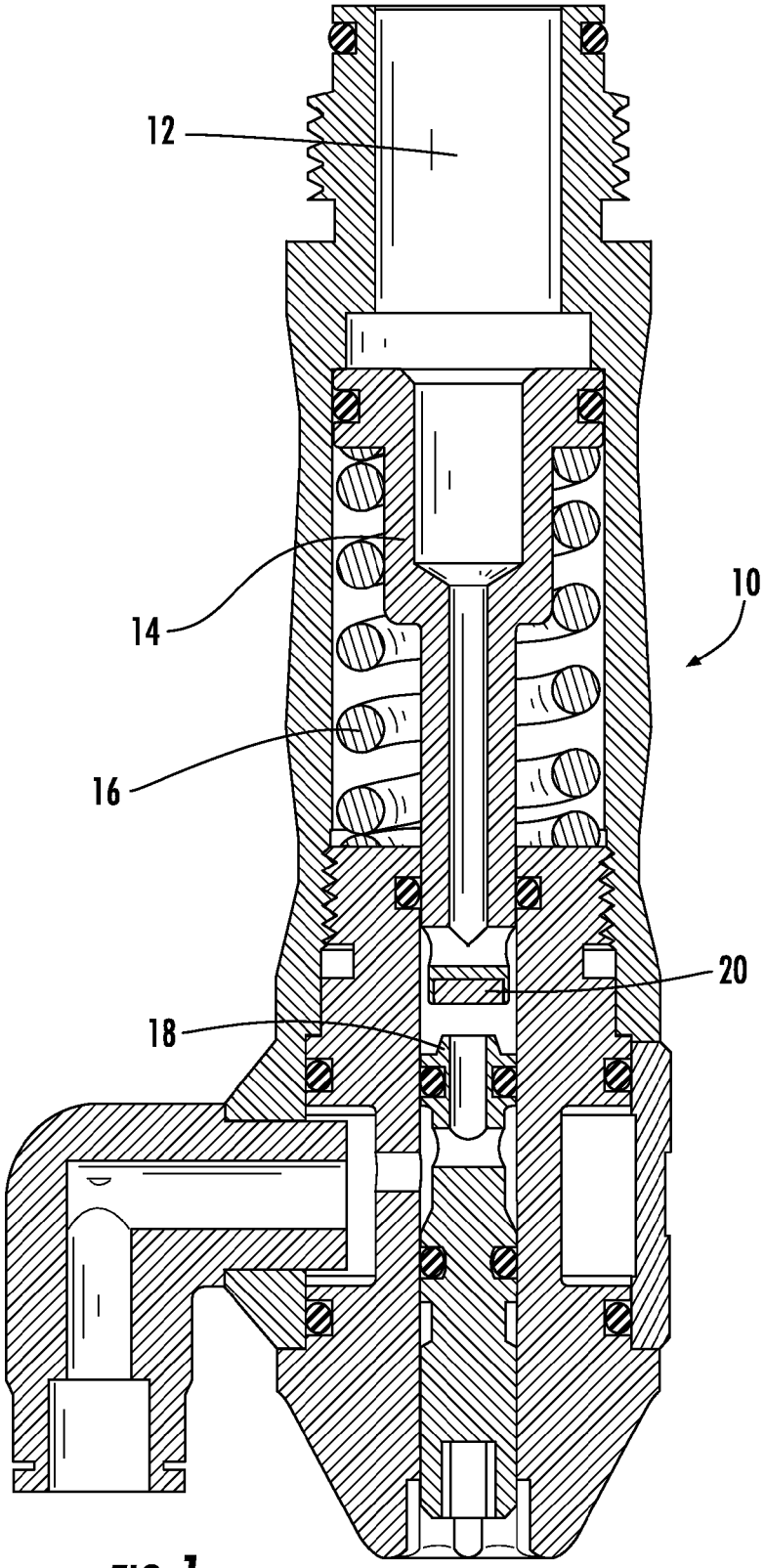
FIG. 1 (PRIOR ART)
FIG. 1 is a cross-sectional view of a prior art normally open downstream regulator design.
Figure 2:
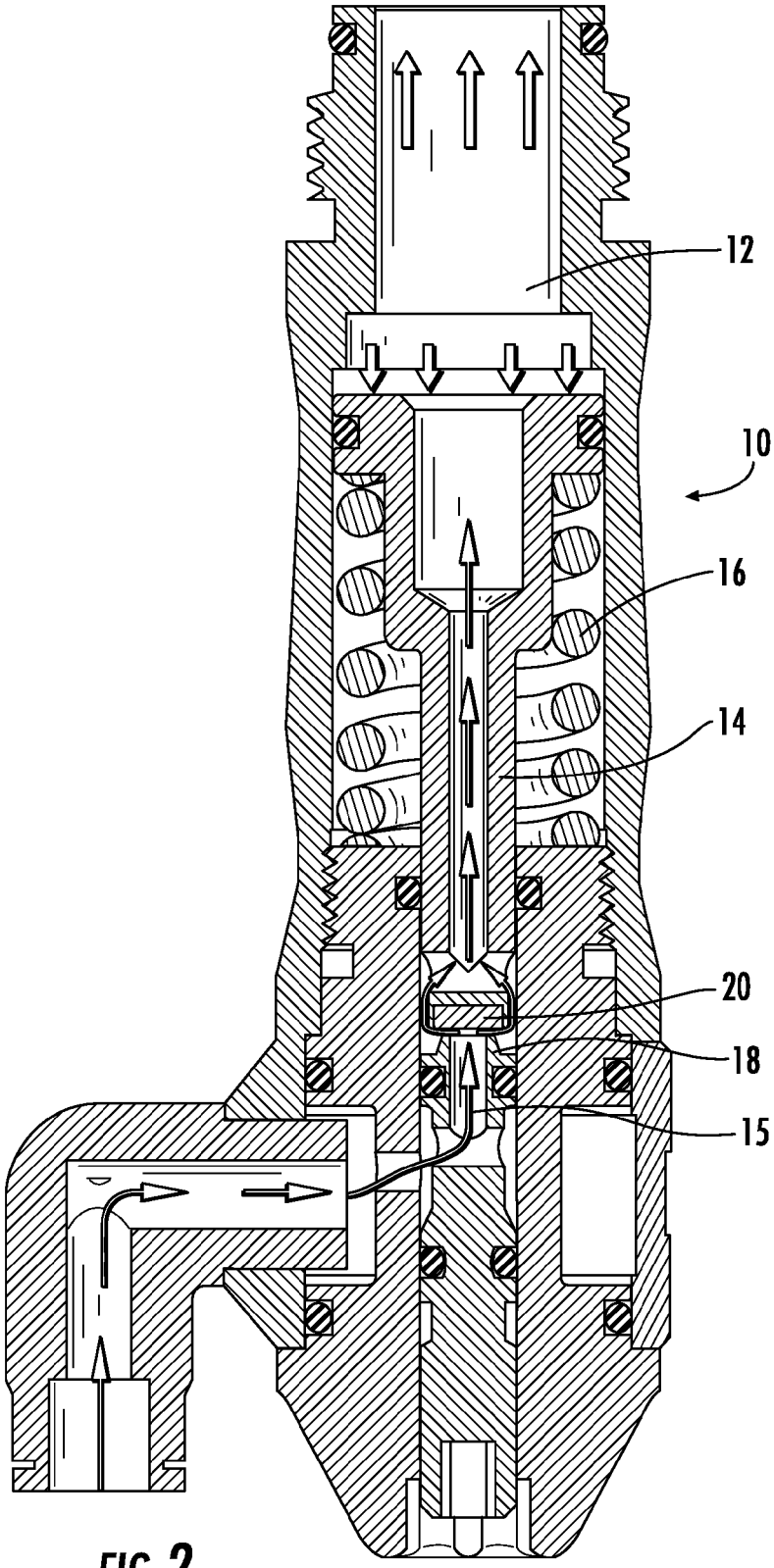
FIG. 2 (PRIOR ART)
FIG. 2 is a cross-sectional view of the regulator of FIG. 1 with a gas supply attached wherein the down stream gas pressure is below the regulated pressure set point.
Figure 3:
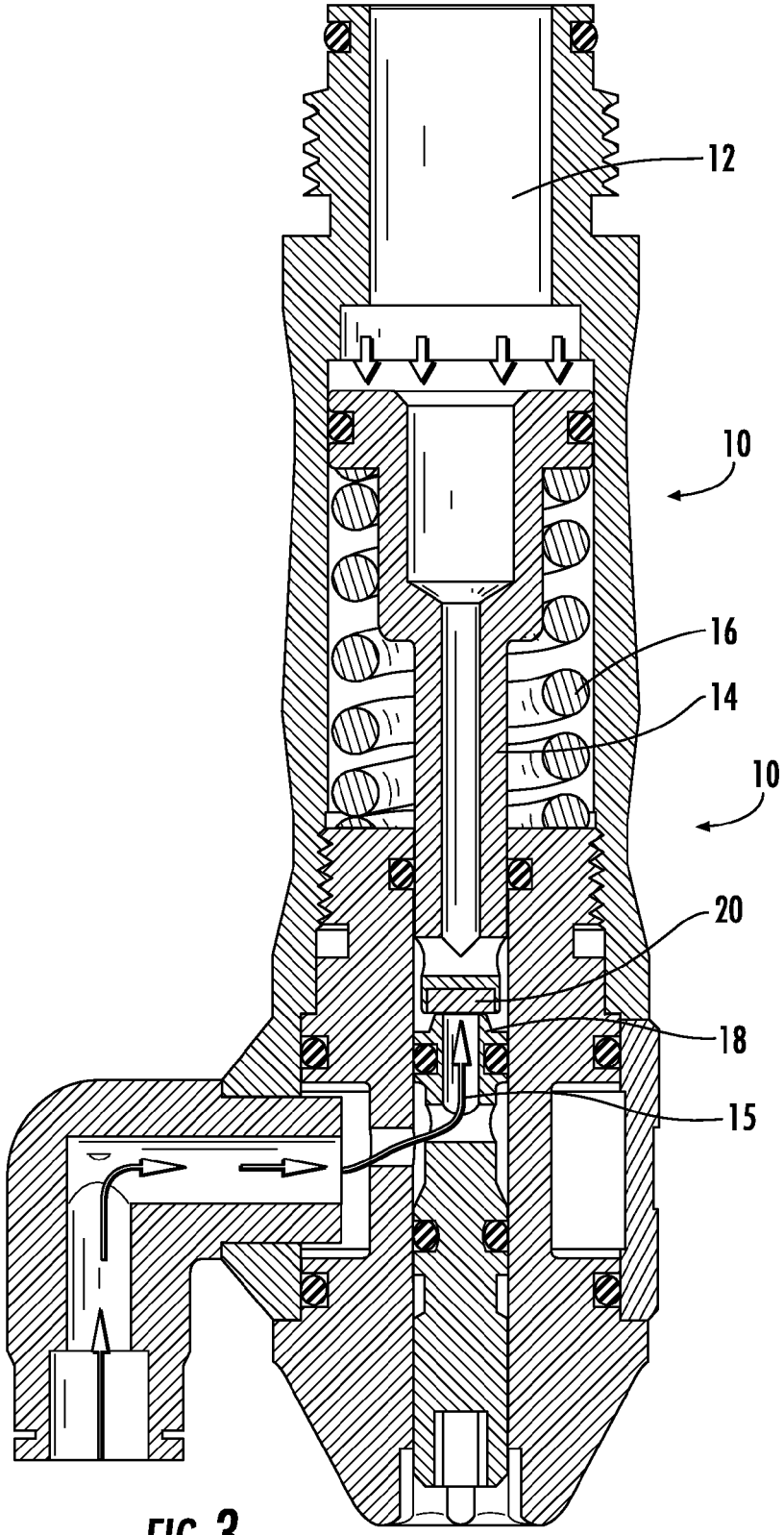
FIG. 3 (PRIOR ART)
FIG. 3 is a cross-sectional view of the regulator of FIG. 1 with a gas supply attached wherein the down stream gas pressure has reached the regulated pressure set point.
Figure 4:
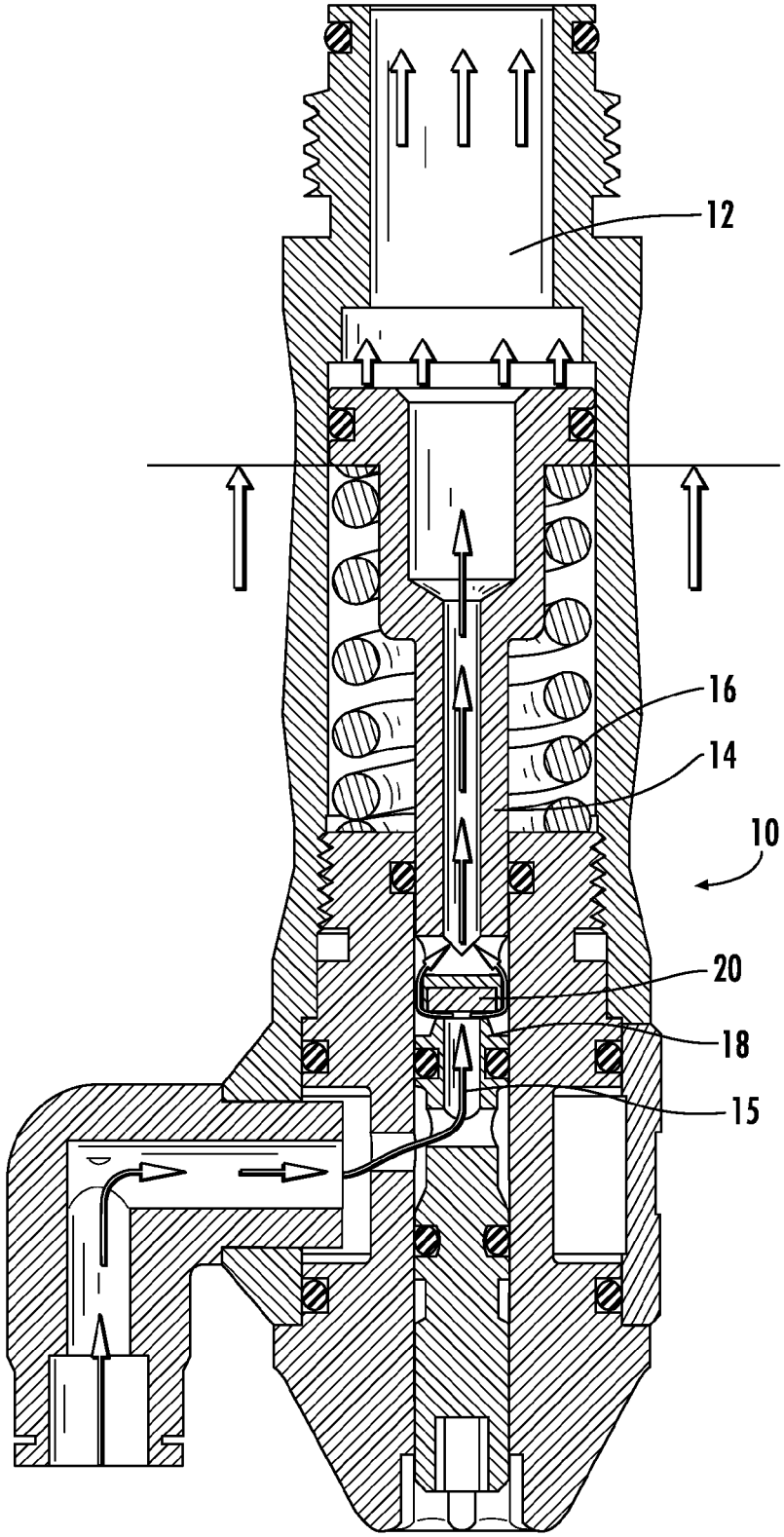
FIG. 4 (PRIOR ART)
FIG. 4 is a cross-sectional view of the regulator of FIG. 1 with a gas supply attached wherein the down stream gas pressure has dropped below the regulated pressure set point.
Figure 5:
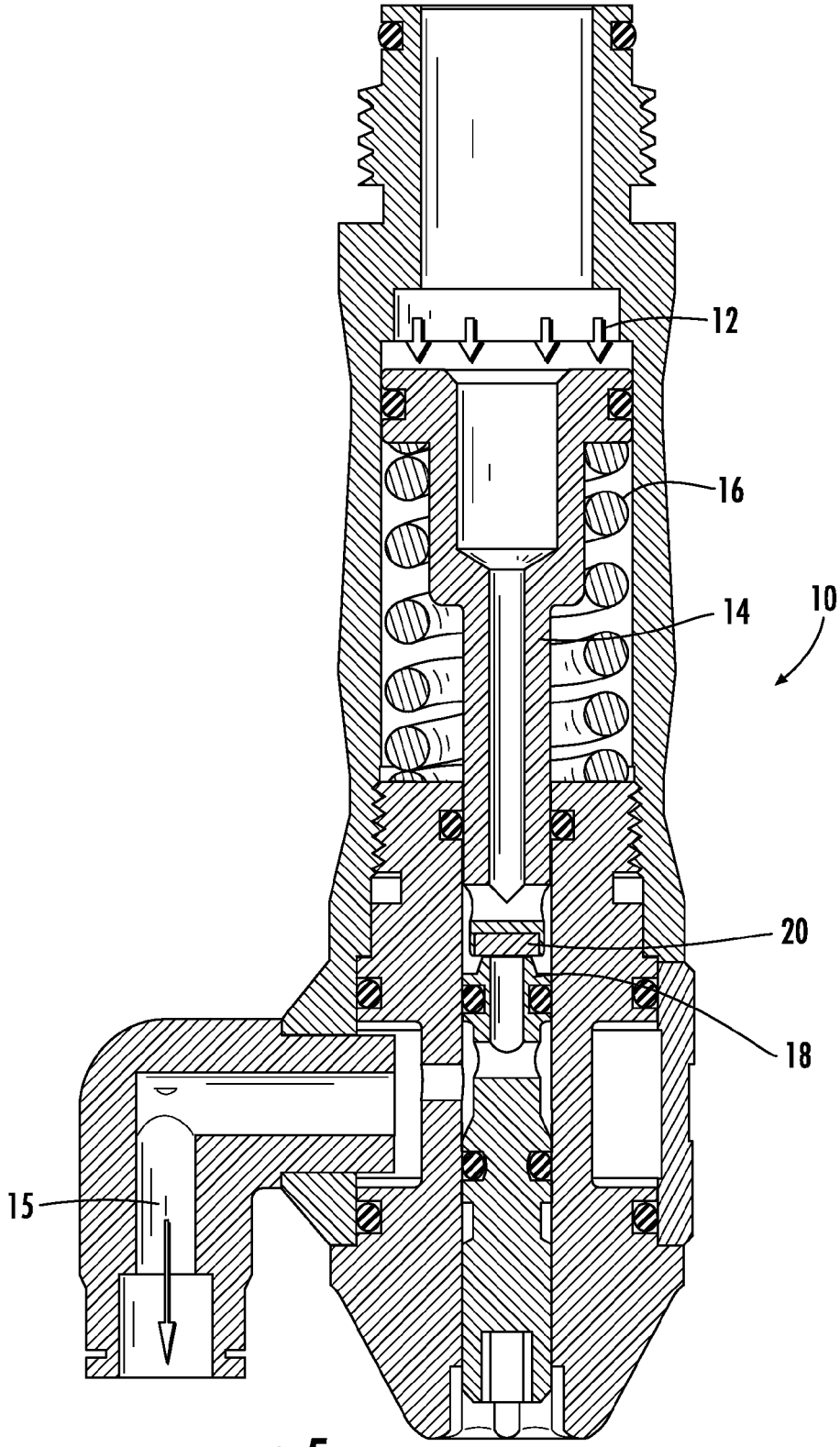
FIG. 5 (PRIOR ART)
FIG. 5 is a cross-sectional view of the regulator of FIG. 1 with a gas supply being removed after the down stream gas pressure has reached the regulated pressure set point.
Figure 6:
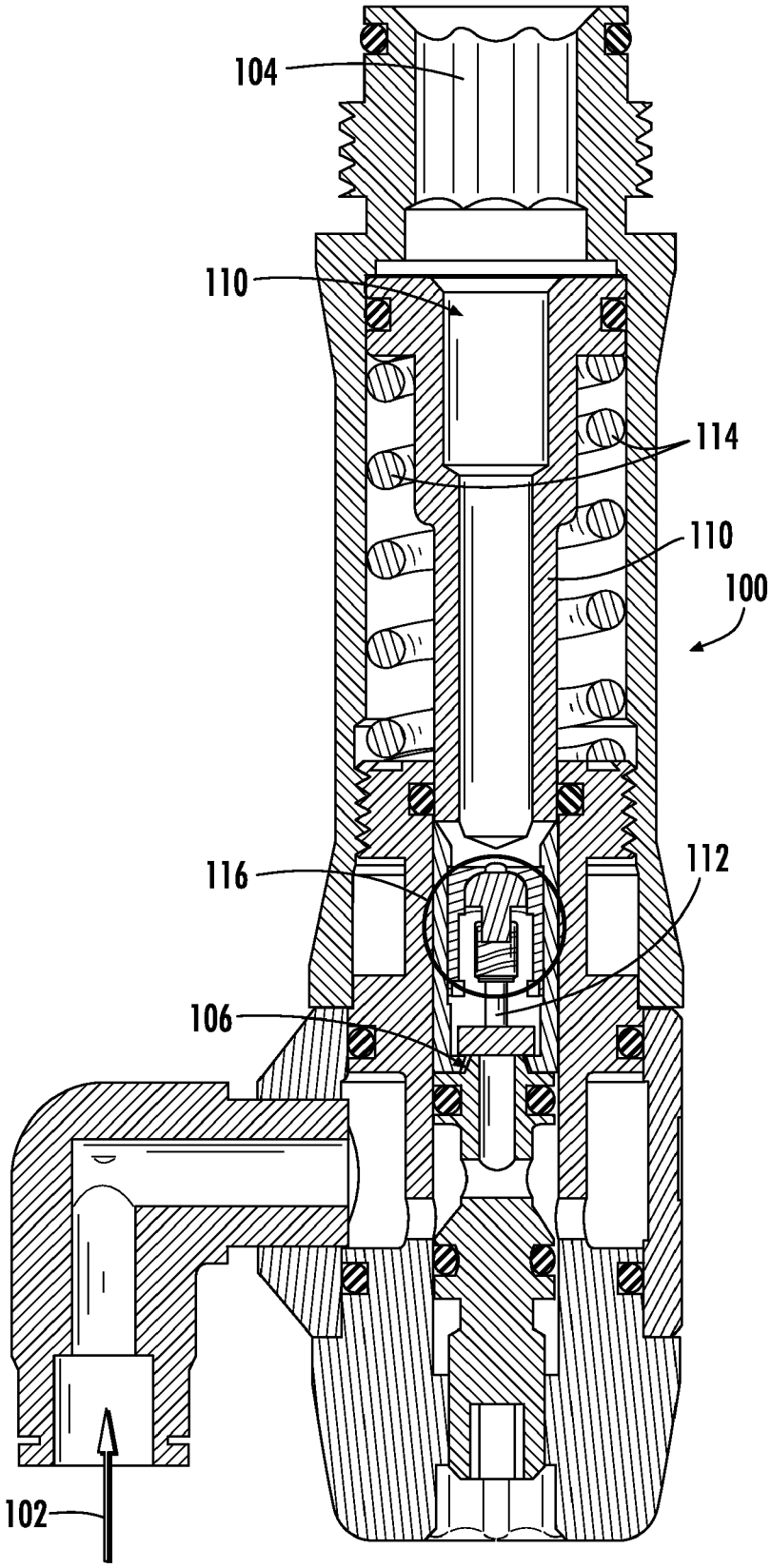
FIG. 6 is a cross-sectional view of the improved pressure regulator of the present invention.
Figure 7:
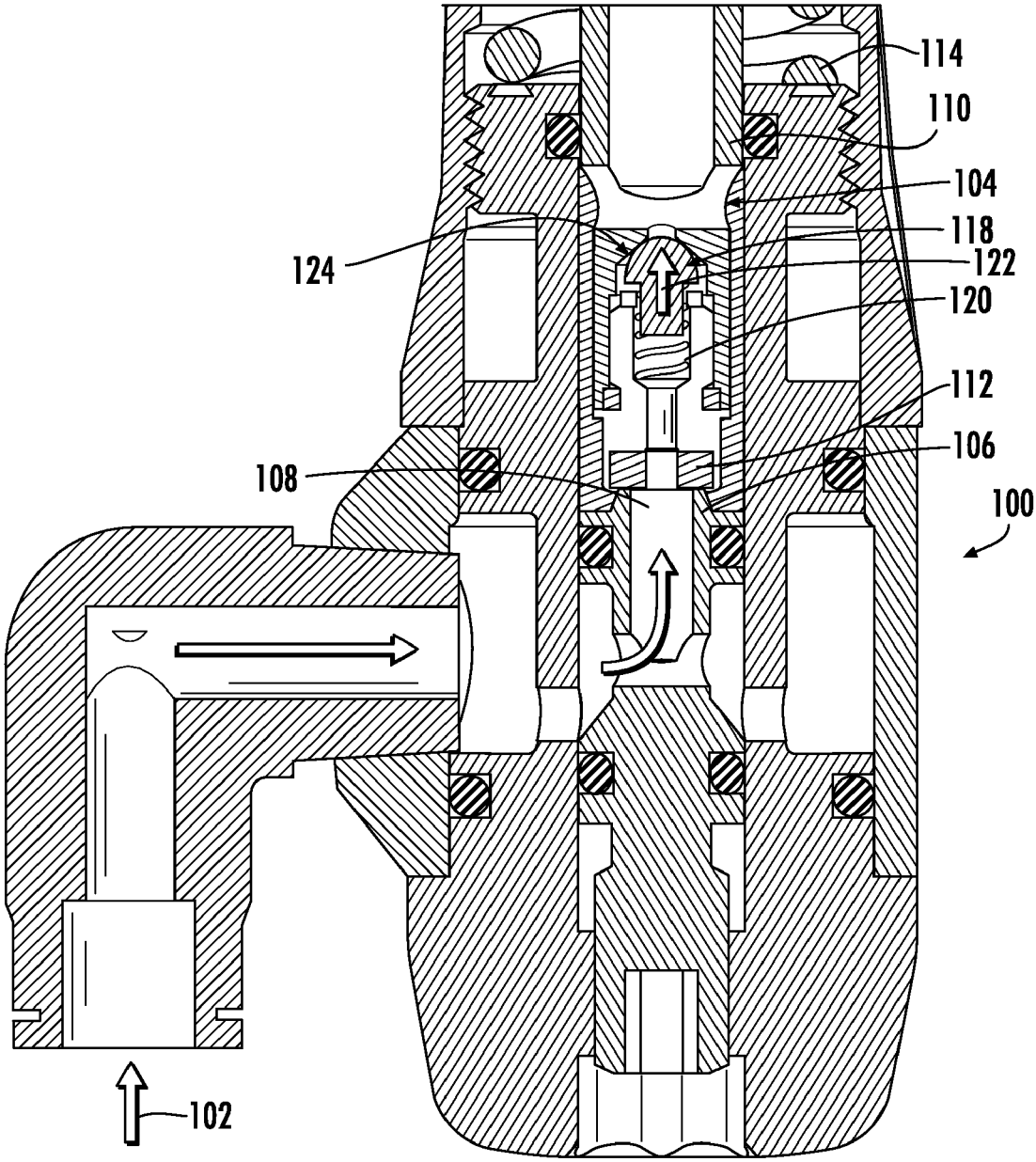
FIG. 7 is a cross-sectional view of the pressure regulator of FIG. 6 with a gas supply attached.
Figure 8:
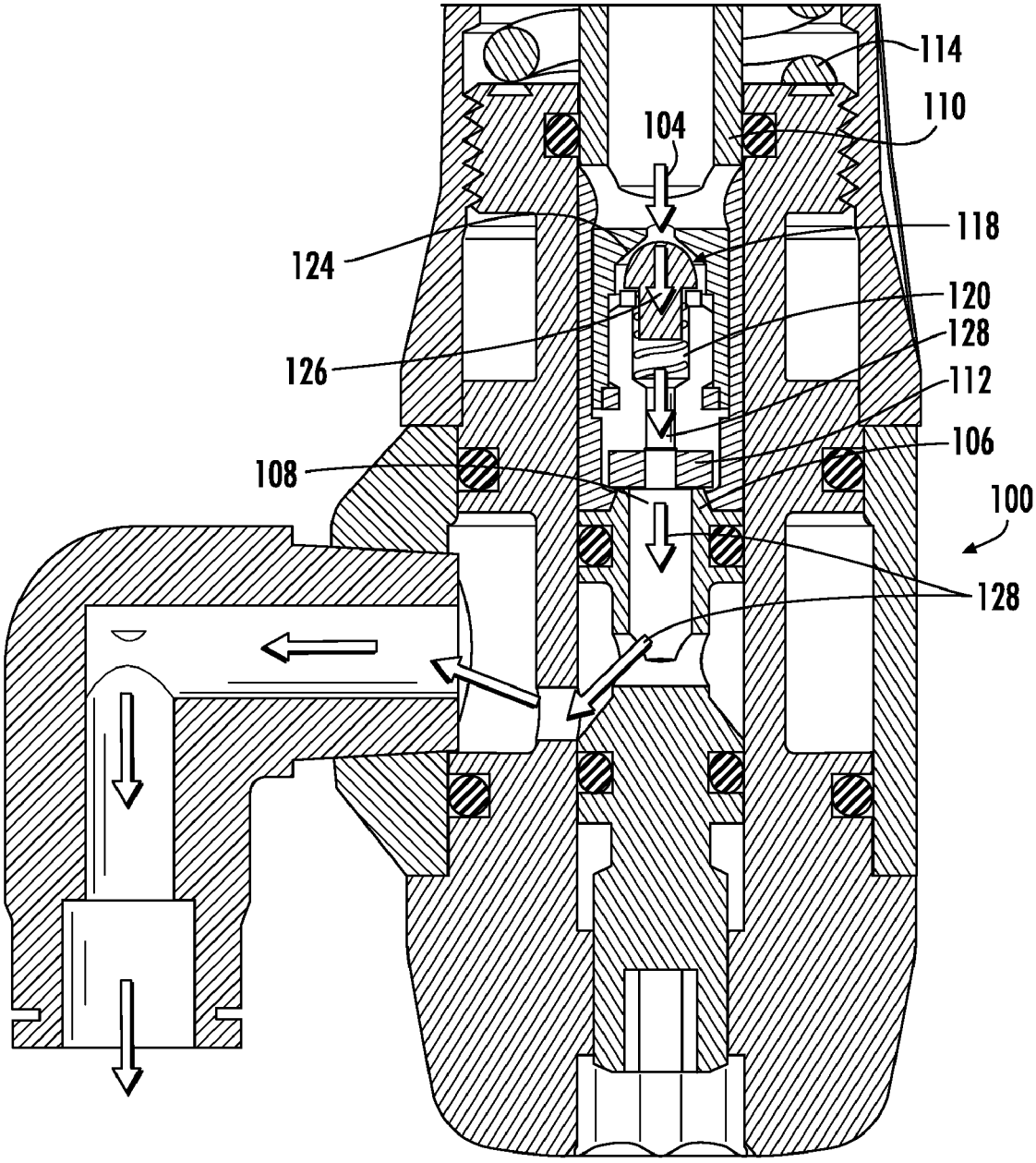
FIG. 8 is a cross-sectional view of the pressure regulator of FIG. 6 with the gas supply removed.

Now referring to the drawings, the improved gas pressure regulator 100 and its operation is shown and generally illustrated at FIGS. 6-8. Generally, the regulator 100 is disposed between a high pressure gas supply 102 and a downstream regulated gas supply 104. The regulator 100 includes a seat 106 with an aperture 108 therein that permits flow of gas from the high-pressure gas supply 102 into the regulator 100, a piston 110 with a seal 112 at one end thereof disposed adjacent the seat 106, a spring 114 that spring biases the piston 110 with the seal 112 thereon to a normally open position relative the seat 106, and a self-purging element 116 or valve disposed in or proximate to the seat 106 that upon removal of the high-pressure gas supply 102 opens to allow release the pressurized downstream regulated gas 104.

In this regard, the present invention provides an improved gas pressure regulator 100 for a paintball marker that preserves the operational benefits and reliability of a NO regulator yet automatically purges the retained pressure downstream of the regulator upon removal of the supply pressure. The automatic purging feature of the pressure regulator of the present invention is created by the inclusion of a pressure-controlled plunger inside the NO regulator piston and seal that allows the regulated downstream gases to be purged from the system as the supply source is removed from the marker. Accordingly, as the downstream regulated gases are allowed to exit the system when the supply source is removed, the paintball marker is rendered inoperable and safe.

Turning to FIG. 6 a cross-section depicting one possible embodiment of the regulator 100 of the present invention is shown. Generally, the basic function of the regulator of the present invention is identical to the function and operation of the prior art downstream NO regulator described in FIGS. 1-5 above with the novel addition of the self-purging functionality. In this regard, the regulator of the present invention includes the same basic components of supply gas 102, downstream regulated gas 104, regulator piston 110, regulator main spring 114, regulator seal 112 and regulator seat 106. In addition to the components listed above, however, the present invention also incorporates a self-purging pressure bleeding feature 116 that can be found mounted inside the regulator piston. The self-purging feature 116 is a plunger 118 that is designed to selectively allow communication of the supply gas side 102 and the downstream regulated gas 104 side of the regulator 100. The plunger 118 is biased to a closed position partially by a spring 120 and partially by the supply gas pressure 102. In normal operation, with supply gas 102 attached to the supply inlet, the supply gas 102 pressure indicated by arrow 122 is greater than the pressure of the regulated downstream gas 104 thereby causing the self-purging plunger 118 to remain closed against the sealing face 124 maintaining the continuity of the seal between the regulator seat 106 and the regulator seal 112. However, when the supply gas pressure 102 is removed, the supply gas 102 pressure indicated by arrow 126 is less than the pressure of the regulated downstream gas 104 the self-purging plunger 118 is displaced downwardly by the down stream regulated gas pressure 104. In other words, the self-purging plunger 118 will either open or remain closed against the sealing surface 124 dependant on which side of self-purging plunger 118 sees the larger pressure differential.

Turning to FIG. 7 the regulator 100 of the present invention is depicted in normal operation with supply gas pressure 102 provided at the supply inlet. While the supply gas pressure 102 is present, the pressure of the supply gas 102 passes through the aperture in the regulator seal 112 urging the plunger 118 upwardly. This supply gas pressure 102 is sufficient to overcome the opposing force of the pressure of the downstream regulated gas 104 acting on the opposing side of the plunger 118 from within the regulator 100 such that the plunger 118 is urged upwards towards the sealing face 124 thereby preventing any communication of gases between the supply side and the downstream side. Thus the downstream side of the regulator remains at the regulated pressure.

At FIG. 8 the regulator 100 of the present invention is shown wherein the supply source gas 102 has been removed. Once the supply gas pressure 102 has been removed, the pressure of the downstream regulated 104 gas becomes the dominant pressure acting on the plunger 118 seal element, forcing it downwardly and away from the sealing surface 124.

This movement of the plunger 118 sealing element allows the downstream regulated gases 104 to flow back as depicted by arrows 128 through the regulator seat 106 and back out of the supply inlet of the regulator. As a result, the retained pressure of the regulated gas is purged thereby depressurizing the paintball marker rendering it safe.

It can therefore be seen that the present invention provides a pressure regulator for a paintball marker that preserves the operational benefits and reliability of a NO regulator yet automatically purges the retained pressure downstream of the regulator upon removal of the supply pressure rendering the paintball marker inoperable and safe. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A gas regulator having a high pressure gas supply and a downstream regulated gas supply, comprising:

a regulator seat that permits flow of gas from said high-pressure gas supply into the regulator;

a regulator piston having a regulator seal at one end thereof disposed adjacent the regulator seat;

a regulator spring that spring biases the regulator piston and the regulator seal to a normally open position relative the regulator seat; and a self-purging valve, positioned between said high pressure gas supply and said downstream regulated gas supply wherein upon removal of the high-pressure gas supply, the self-purging valve opens to allow release of the downstream regulated gas.

2. The gas regulator of claim 1, wherein said regulator is disposed between said high pressure gas supply and said downstream regulated gas supply within a paintball marker.

3. The gas regulator of claim 2, wherein said self purging valve purges retained pressure from said downstream regulated gas supply upon removal of the high pressure gas supply rendering the paintball marker inoperable and safe.

4. The gas regulator of claim 1, wherein said self purging valve has a supply side and a regulated side, said self purging valve being displaced to an open position when a gas pressure on said regulated side is greater than a gas pressure on said supply side.

5. The gas regulator of claim 1, wherein said self purging valve has a supply side and a regulated side, said self purging valve being maintained in a closed position by a gas pressure applied to said supply side, said self purging valve being displaced to an open position when a gas pressure on said regulated side is greater than a gas pressure on said supply side.

6. The gas regulator of claim 1, wherein said self purging valve comprises:

a plunger disposed proximate said regulator seal;

a valve seat, said plunger received within said valve seat; and a spring exerting a spring force on said plunger to urge said plunger to said valve seat.

7. The gas regulator of claim 6, wherein said self purging valve has a supply side and a regulated side, said self purging valve being displaced against said spring force to an open position when a gas pressure on said regulated side is greater than a combination of said spring force and said gas pressure on said supply side.

8. The gas regulator of claim 6, wherein said self purging valve has a supply side and a regulated side, said self purging valve being maintained in a closed position by a gas pressure applied to said supply side, said self purging valve being displaced to an open position when a gas pressure on said regulated side is greater than a combination of said spring force and said gas pressure on said supply side.

9. The gas regulator of claim 6, wherein said regulator is disposed between said high pressure gas supply and said downstream regulated gas supply within a paintball marker.

10. The gas regulator of claim 6, wherein said self purging valve purges retained pressure from said downstream regulated gas supply upon removal of the high pressure gas supply rendering the paintball marker inoperable and safe.

11. A gas regulator having a high pressure gas supply and a downstream regulated gas supply, the regulator comprising:

a regulator seat that permits flow of gas from said high-pressure gas supply into the regulator;

a regulator piston having a regulator seal at one end thereof disposed adjacent the regulator seat;

a regulator spring that spring biases the regulator piston and the regulator seal to a normally open position relative the regulator seat; and a self-purging valve disposed between said high pressure gas supply and said downstream regulated gas supply, wherein said flow of high pressure gas into the regulator displaces the regulator piston against the spring bias until the flow of gas reaches a regulated pressure that causes the regulator piston to close the regulator seal against the regulator seat retaining downstream regulated gas within the regulator, wherein upon removal of the high-pressure gas supply, the self-purging valve opens to allow release of the downstream regulated gas.

12. The gas regulator of claim 11, wherein said regulator is disposed within a paintball marker between said high pressure gas supply and said downstream regulated gas supply, said release of retained pressure from said downstream regulated gas supply upon removal of the high pressure gas supply rendering the paintball marker inoperable and safe.

13. The gas regulator of claim 11, wherein said self purging valve has a supply side and a regulated side, said self purging valve being displaced to an open position when a gas pressure on said regulated side is greater than a gas pressure on said supply side.

14. The gas regulator of claim 11, wherein said self purging valve has a supply side and a regulated side, said self purging valve being maintained in a closed position by a gas pressure applied to said supply side, said self purging valve being displaced to an open position when a gas pressure on said regulated side is greater than a gas pressure on said supply side.

15. The gas regulator of claim 11, wherein said self purging valve comprises:

a plunger disposed proximate said regulator seal;

a valve seat, said plunger received within said valve seat; and a spring exerting a spring force on said plunger to urge said plunger to said valve seat.

16. The gas regulator of claim 15, wherein said self purging valve has a supply side and a regulated side, said self purging valve being displaced against said spring force to an open position when a gas pressure on said regulated side is greater than a combination of said spring force and said gas pressure on said supply side.

17. The gas regulator of claim 15, wherein said self purging valve has a supply side and a regulated side, said self purging valve being maintained in a closed position by a gas pressure applied to said supply side, said self purging valve being displaced to an open position when a gas pressure on said regulated side is greater than a combination of said spring force and said gas pressure on said supply side.

18. The gas regulator of claim 15, wherein said regulator is disposed within a paintball marker said release of retained pressure from said downstream regulated gas supply upon removal of the high pressure gas supply rendering the paintball marker inoperable and safe.

* * * * *